US007384299B1

(12) United States Patent
Bridges et al.

(10) Patent No.: US 7,384,299 B1
(45) Date of Patent: Jun. 10, 2008

(54) SELF POSITIONING, LATCHABLE CABLE TROUGH

(75) Inventors: Jeremy Scott Bridges, Apex, NC (US); David Lee Hager, Wake Forest, NC (US); Dean Frederick Herring, Youngsville, NC (US); Paul Andrew Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/687,762

(22) Filed: Mar. 19, 2007

(51) Int. Cl.
*H01R 13/56* (2006.01)

(52) U.S. Cl. ..... 439/445; 439/354; 439/374; 439/926

(58) Field of Classification Search ..... 439/445–447, 439/449, 926, 374, 354
See application file for complete search history.

(56) References Cited

U.S. PATENT DOCUMENTS

| | | | | |
|---|---|---|---|---|
| 4,367,967 | A | 1/1983 | Albert | |
| 5,037,175 | A * | 8/1991 | Weber | 385/76 |
| 5,451,171 | A * | 9/1995 | Dickie | 439/447 |
| 5,685,736 | A * | 11/1997 | Lung | 439/447 |
| 6,447,170 | B1 | 9/2002 | Takahashi et al. | |
| 6,733,322 | B2 * | 5/2004 | Boemmel et al. | 439/445 |
| 6,773,297 | B2 | 8/2004 | Komiya | |
| 6,926,551 | B1 | 8/2005 | Schulz et al. | |
| 7,029,311 | B2 | 4/2006 | Peloza | |
| 2004/0014352 | A1 | 1/2004 | Boemmel et al. | |
| 2004/0043654 | A1 | 3/2004 | Lee et al. | |
| 2004/0077207 | A1 | 4/2004 | Ice | |

FOREIGN PATENT DOCUMENTS

| | | | |
|---|---|---|---|
| DE | 3821017 | * | 1/1989 |

* cited by examiner

*Primary Examiner*—Neil Abrams
*Assistant Examiner*—Phuong Nguyen
(74) *Attorney, Agent, or Firm*—Cynthia Byrd; Jeffrey L. Streets; Streets & Steele

(57) ABSTRACT

An apparatus for latching, aligning, and connecting a first connector located in a chassis with a second connector on a cable. The invention comprises a plurality of trough segments coupled in series. The trough segments include a distal trough segment having a retainer for securing and axially orienting a cable connector, a proximal trough segment having a latch element selectively secureable to a guide passage, and one or more intermediate trough segments coupled between the distal trough segment and the proximal trough segment. Each individual trough segment is pivotally coupled to any adjacent trough segment to allow bending of the cable trough. The cable trough formed by the collective trough segments may be directed into the guide passage for coupling of the cable connector to an internal chassis connector and latching of the cable trough in position within the guide passage.

12 Claims, 3 Drawing Sheets

SELF POSITIONING, LATCHABLE CABLE TROUGH

BACKGROUND OF THE INVENTION

1. Field of the Invention

The present invention relates to the use of cables to interconnect computer hardware. More specifically, the present invention is an apparatus for coupling a cable to a difficult to reach connector in a computer system.

2. Description of the Related Art

Computer systems have many component parts designed to operate cooperatively and there are various types of connections between the component parts that may be required. For example, server systems will often have several electronic circuit boards that each have electronic components, including a processor, that perform operations in communication with each other. While an electronic circuit board may be connected directly to a connector on a second electronic circuit board, electronic circuit boards are often connected with cables that allow communication there between.

The scalability of certain types of computer systems, including blade servers, facilitates the addition of new components or the reconfiguration of existing components in a data center. Scalability, however, relies upon the ability to interconnect multiple chassis via cables. This interconnection can be complicated due to the fact that chassis that house blade servers or other computer system components are often configured very close to each other in order to conserve space in a data center environment. Furthermore, even the components within the chassis are very tightly configured to provide a high component density. In fact, some computer components may be positioned in such a manner within a chassis that reaching a desired connector is difficult without removal of numerous components from the chassis.

Some systems that contain difficult to reach components may include a cable interposer, or a run of cable that is connected to a difficult to reach component in order to provide a connector that is more readily accessible. However, the usage of a cable interposer adds undesirable signal losses and a cable connected deep within the chassis will have a latch at the connector that is unreachable by the user. Furthermore, the depth of the connection typically precludes the use of rigid cables that may exit perpendicularly from a chassis.

Still, high speed performance is a critical factor in some computer systems. Therefore, it is desirable to configure components for optimum communication and operational speed. Long runs of communication cable between components can cause signal losses or lags in performance. Consequently, it is often desirable to minimize the length of cable between components in order to optimize performance.

Therefore, there is a need for an apparatus to facilitate a cable connection with a difficult to reach component having a deep plug. It would be desirable if the apparatus also facilitated latching and unlatching of the cable without removal of adjacent components. Furthermore, it would be even more desirable if the apparatus did not require a redesign of exiting scalability cables or connectors for receiving the cables.

SUMMARY OF THE INVENTION

The present invention provides a method and apparatus for aligning, connecting and latching, a cable having a second connector with a first connector located deep within a chassis. The apparatus comprises a plurality of flexibly connected trough segments that collectively form a cable trough that secures a cable. The trough segments preferably share one or more common lateral dimension that cooperates with a chassis guide to align the first and second connectors.

The plurality of trough segments includes a distal segment having a retainer capable of receiving a second connector and maintaining the second connector in a desired orientation. A proximal segment comprises a latch element which, when coupled with a fixed structure, selectively secures the cable trough in place once the second connector is received into the first connector. The latch may be selectively unlatched by a user for removal of the cable trough and disengagement of the connectors.

The chassis guide slidably receives the trough segments and is positioned in a manner to align the first and second connectors when the cable trough is inserted within the chassis guide. The chassis guide comprises a proximal opening for receiving the trough segments and a distal opening aligned with the first connector, wherein the guide selectively positions the cable trough for the first and second connectors to mate.

DETAILED DESCRIPTION OF PREFERRED EMBODIMENTS

The present invention provides an apparatus for aligning, connecting and latching a first connector located in a chassis with a second connector on a cable. The apparatus comprises a plurality of flexibly connected trough segments that collectively form a cable trough capable of housing a cable. The trough segments preferably share one or more common dimension with a guide used to align the first and second connectors. The trough segments are preferably composed of a lightweight and strong material, such as a plastic.

The flexible connection between trough segments may include a pivotal hinge, a swivel, a flexible material, or any connection that will allow the trough segments to articulate with respect to each other. The preferred connection will allow the trough segments to articulate in at least one plane relative to an adjacent trough segment while also being relatively incompressible along the axis of the trough, to provide rigidity when pushed from the proximal end.

The cable trough further comprises a retainer and a latch. The retainer is generally located near the distal end of the cable trough and is capable of receiving the second connector, which forms part of a cable, and maintaining the second connector in a desired position and orientation. Further, the retainer may be formed to receive the second connector, or be coupled with a fastener to maintain the second connector in place. The latch is generally located near the proximal end of the cable trough and selectively secures the trough in place within the chassis guide once the second connector has been received into the first connector. A user may selectively secure the trough in place by latching the trough to a guide, a chassis, or any other stable structure.

The chassis guide slidably receives the trough segments and is positioned in a manner to align the first and second connectors when the cable trough is inserted within the chassis guide. The chassis guide comprises a proximal opening for receiving the trough segments and a distal opening aligned with the first connector.

The trough segments are preferably biased to predispose the segments to a specific relational configuration, such as a straight or curved line. The bias may be a physical property of the material used to the make the trough segments or the bias may be provided by incorporation of a separate biasing member, such as a plastic rod, a thin metal piece, or any other biasing member spanning two or more trough segments. The biasing member acts as a spring when the trough segments are moved in relation to one another, causing the trough segments to tend toward a specific relationship.

Figure 1:
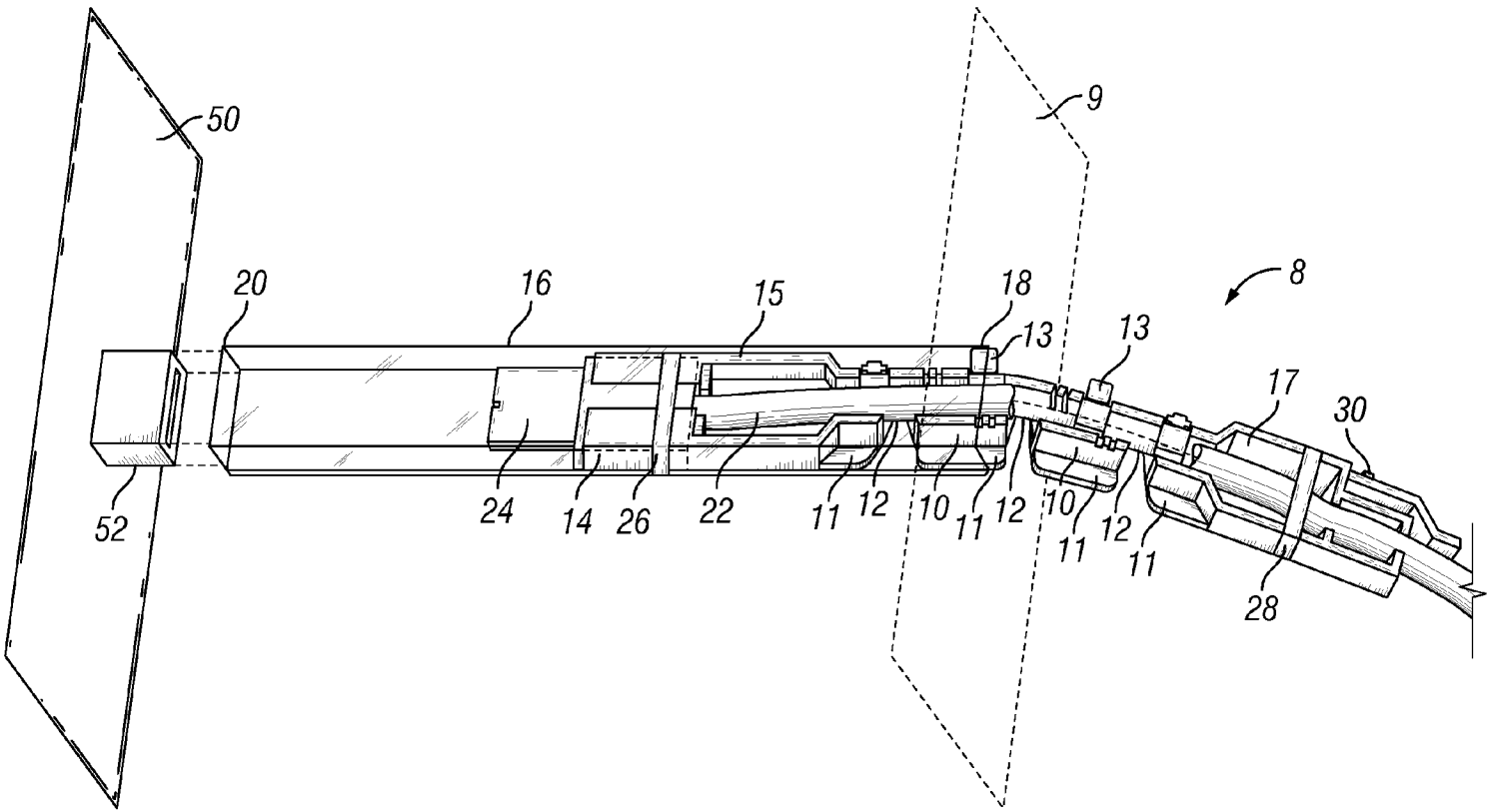
FIG. 1 is a perspective view of a cable trough of the present invention with the trough segments partially inserted into a guide.

FIG. 1 is a perspective view of one embodiment of a cable trough 8 with the trough segments partially inserted into a chassis guide 16 that extends into a chassis 9. The cable trough 8 comprises a distal trough segment 15, one or more intermediate trough segments 10, and a proximal trough segment 17. The trough segments 10, 15, 17 are serially ordered to form a flexible cable trough capable of securing a connection cable 22. A retainer 14 is located at the distal end of the distal trough segment 15 in order to secure a connector 24 of the connection cable 22. The proximal trough segment 17 contains a latch element 30, shown in greater detail in FIG. 3. The trough segments 10, 15, 17 are flexibly connected adjacent segments, such as by an integral necked portion 12, to allow movement in relation to one another in one or more plane.

A chassis guide 16 receives the cable trough 8 formed by the trough segments 10, 15, 17 by inserting the cable trough into a proximal opening 18 of the guide 16. The guide 16 is fixed in position such that a distal opening 20 of the guide 16 is aligned with a first connector 52 on a component 50 within a chassis. A cable 22 is seated within the trough formed collectively by the trough segments 10, 15, 17. Furthermore, the cable 22 comprises the connector 24, which is seated within the retainer 14. An optional fastener 26 may hold the second connector 24 in place in the retainer 14. Also, an optional fastener 28 may hold the cable 22 within the trough. Preferably the fasteners are integral to the segments and can be reused should the cable require replacement.

The trough segments 10, 15, 17 preferably share one or more common dimension with the interior walls of the chassis guide. In this example, a rib 11 extends outward to the side of the trough segments 10, 15, 17. These ribs 11 extend to about the same width as the inner width of the guide 16 so that the ribs are slidably received in the guide, but prevent significant lateral or rotational movement of the trough segments 10, 15, 17 relative to the guide. Further, this example shows trough segments 10, 15, 17 that have an extension 13 which extends to about the same height as the inner height of the guide 16.

The trough segments 10, 15, 17 can be freely articulated while they are outside the guide, thereby allowing the cable trough to be fed into the proximal opening 18 of the guide 16 from a variety of angles. However, as the trough segments are inserted into the guide 16, the trough segments 10, 15, 17 are sequentially constrained by the ribs 11 and extensions 13 to maintain an orientation as specified by the path of the guide 16. While the rib 11 constrains movement laterally, the extension 13 constrains vertical movement. This ensures that the first and second connectors 52, 24 are properly aligned. It should be recognized that trough segments should slide easily through the guide without requiring large forces to overcome friction. It should also be recognized that slightly undersizing the trough segments allows the guide to include gently curved paths that the cable trough can follow without binding.

Figure 2:
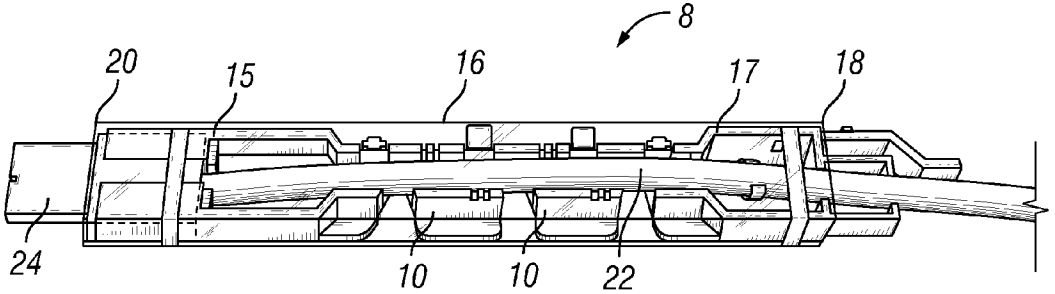
FIG. 2 is a perspective view of the cable trough with the trough segments fully inserted into a guide.

FIG. 2 is a perspective view of the cable trough 8 fully inserted into the guide 16. The guide 16 has positioned the trough segments 10 in a desired configuration, in this instance a straight line. Positioning of the cable trough through cooperation with the guide 16 results in the positioning of the cable 22 housed in the trough. The second connector 24 has been positioned at the distal opening of the guide 20, to be received in a first connector (not shown).

Figure 3:
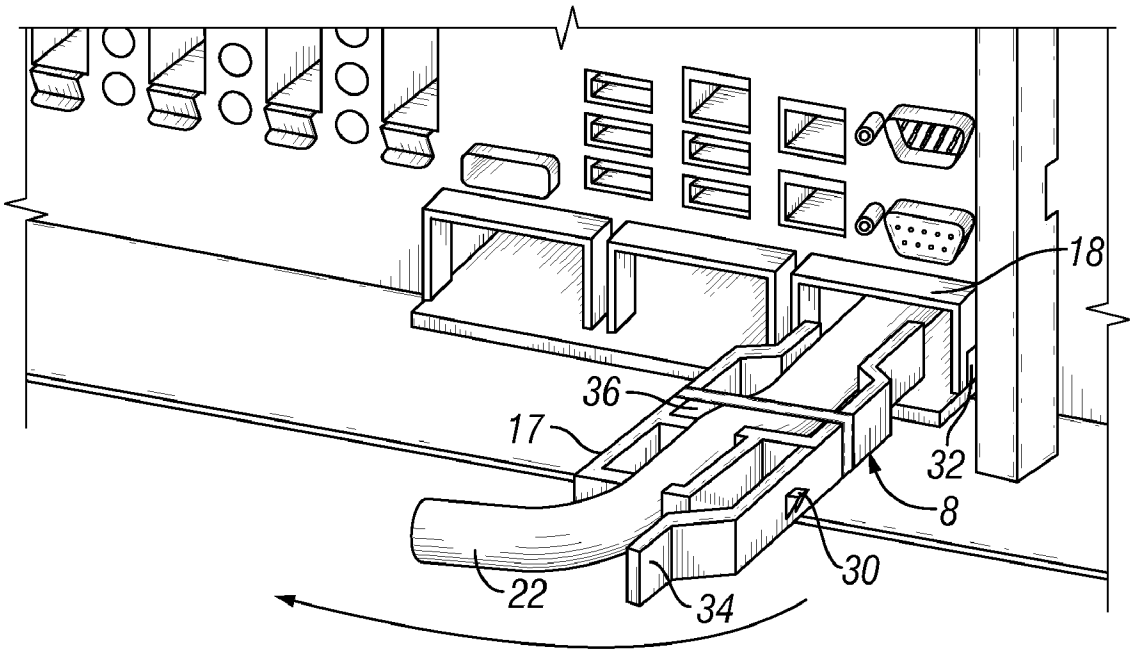
FIG. 3 is a perspective view of a chassis having a cable trough inserted into a chassis guide.

FIG. 3 is a perspective view of a chassis having the cable trough 8 inserted into a chassis guide through the proximal opening 18. The proximal segment 17 has a latch element 30, such as a latch pin, that selectively secures the cable trough to a mating latch element 32, such as notch in the chassis or the guide itself. In this instance, the user may release the latch element 30 by flexing the latch arm 34. Also shown in the proximal segment 17 is an optional offset 36 for the cable trough to help maintain the cable 22 in place with greater friction against the sides of the cable 22.

Figure 4:
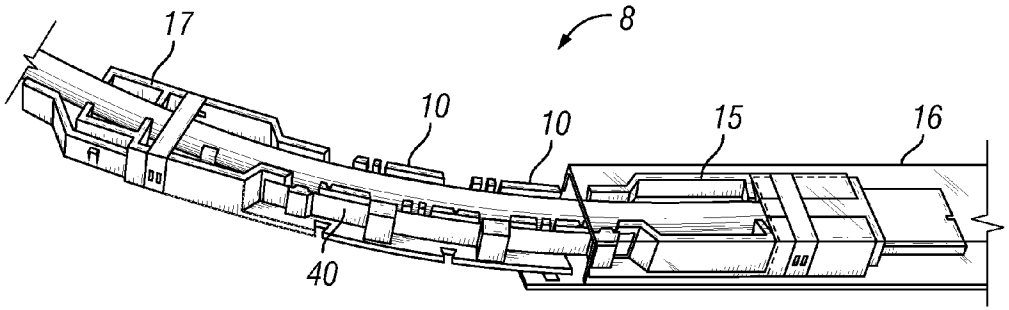
FIG. 4 is a perspective view of a second side of the cable trough having a biasing member.

FIG. 4 is a perspective view of the cable trough 8 showing a separate biasing member 40 spanning between the trough segments 10, 15, 17. The biasing member 40 acts as a spring, allowing the cable trough to bend, as shown in the figure, but predisposing the trough segments to a specific alignment with respect to one another, in this example a straight line, when not acted upon by an outside force. The biasing member 40 is shown as a resilient metal strip.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cable trough comprising:

a plurality of trough segments coupled in series, wherein the plurality of trough segments include a distal trough segment having a retainer for securing and axially orienting a cable connector, a proximal trough segment having a latch element selectively secureable to a fixed structure, and one or more intermediate trough segments coupled between the distal trough segment and the proximal trough segment, wherein each trough segment is pivotally coupled to any adjacent trough segment to allow bending of the cable trough, and wherein the cable trough is directed into the guide passage for coupling of the cable connector to an internal chassis connector and latching of the cable trough in position within the guide passage.

2. The apparatus of claim 1, wherein the trough segments are directly connected by a swivel.

3. The apparatus of claim 1, wherein the trough segments are directly connected by a flexible material.

4. The apparatus of claim 1, wherein the trough segments are directly, pivotally connected.

5. The apparatus of claim 1, wherein the trough segments are formed from a single piece of material.

6. The apparatus of claim 1, wherein each trough segment has a common lateral dimension.

7. The apparatus of claim 1, wherein the cable trough includes a biasing member between adjacent trough segments to urge the trough segments toward a desired configuration.

8. The apparatus of claim 1, further comprising:

a cable seated in the cable trough, the cable having a cable connector secured and axially oriented by the retainer.

9. The apparatus of claim 1, wherein the one or more intermediate trough segments include a fastener maintaining the cable in the trough.

10. The apparatus of claim 1, further comprising:

a guide passage secured within a chassis having an internal chassis connector, wherein the guide passage has a distal end opening aligned with the internal chassis connector and a proximal end forming a latch element and an opening that is accessible from outside the chassis.

11. The apparatus of claim 10, wherein the guide passage is straight.

12. The apparatus of claim 10, wherein the guide passage is curved.

* * * * *